US011530080B1

(12) United States Patent
Yeh

(10) Patent No.: US 11,530,080 B1
(45) Date of Patent: Dec. 20, 2022

(54) PAPER CUP HOLDER WITH CARRYING HANDLES

(71) Applicant: Ya-Ming Yeh, New Taipei (TW)

(72) Inventor: Ya-Ming Yeh, New Taipei (TW)

( * ) Notice: Subject to any disclaimer, the term of this patent is extended or adjusted under 35 U.S.C. 154(b) by 0 days.

(21) Appl. No.: 17/365,324

(22) Filed: Jul. 1, 2021

(51) Int. Cl.
*B65D 71/62* (2006.01)

(52) U.S. Cl.
CPC .. *B65D 71/0033* (2013.01); *B65D 2571/0029* (2013.01); *B65D 2571/0066* (2013.01); *B65D 2571/00141* (2013.01); *B65D 2571/00351* (2013.01); *B65D 2571/00462* (2013.01); *B65D 2571/00716* (2013.01)

(58) Field of Classification Search
CPC .. B65D 71/00; B65D 71/004; B65D 71/0033; B65D 71/062; B65D 2571/00141; B65D 2571/0029; B65D 2571/00351; B65D 2571/0037; B65D 2571/00456; B65D 2571/00462; B65D 2571/00487; B65D 2571/0066; B65D 2571/00716; B65D 2571/00728; B65D 2571/00932
USPC ..... 206/141, 162, 189, 193, 197, 427
See application file for complete search history.

(56) References Cited

U.S. PATENT DOCUMENTS 2,613,867 A * 10/1952 Darr ..... B65D 5/46088 229/117.14
3,104,046 A * 9/1963 Arneson ..... B65D 71/0022 229/117.18
3,897,873 A * 8/1975 Graser ..... B65D 71/48 206/199
4,146,168 A * 3/1979 Hartline ..... B65D 71/0048 206/194
8,365,917 B2 * 2/2013 Olesen ..... B65D 71/004 206/187

FOREIGN PATENT DOCUMENTS

EP 567412 A1 * 10/1993 ..... B65D 5/001
TW M577004 U 4/2019
TW M595102 U 5/2020

* cited by examiner

*Primary Examiner* — Bryon P Gehman
(74) *Attorney, Agent, or Firm* — Muncy, Geissler, Olds & Lowe, P.C.

(57) ABSTRACT

The invention provides a paper cup holder with carrying handles, comprising a first base board, a first wall board, a surface board, a second wall board and a second base board located on one extension line, connected sequentially, and forming a tubular structure. The first and second base boards overlap with each other and jointly serve as a bottom surface of the tubular structure. The first base board is partially connected with the surface board to increase a load capacity of the paper cup holder. The surface board is provided with two carrying handle forming line sets and at least two cup inlet forming lines. The surface board forms two carrying handles based on the two carrying handle forming line sets and forms two hollow areas, and each of the two hollow areas and at least one of the cup inlet forming lines jointly form a cup inlet.

11 Claims, 5 Drawing Sheets

PAPER CUP HOLDER WITH CARRYING HANDLES

FIELD OF THE INVENTION

The invention relates to a paper cup holder, and more particularly to a paper cup holder which strengthens the load capacity through its own structural design.

BACKGROUND OF THE INVENTION

It is found that the current patents TW M595102, TW M577004 have disclosed the structure of the portable cup holder. First, for the TW M595102 patent, the portable cup holder disclosed in the patent is only a board structure without a bottom support structure, that is to say, the portable cup holder positions beverage cups on the board. However, this type of portable cup holder would limit the size of the beverage cup placed on it. If the diameter of the beverage cup is too small for the mounting hole to limit the position of the beverage cup, the beverage cup will automatically fall off from the mounting hole. In addition, for the TW M577004 patent, the portable cup holder disclosed in this patent solves the aforementioned problem that the portable cup holder may not be able to hold beverage cups. However, this type of portable cup holder is directly formed, which causes this type of portable cup holder cannot be stacked tightly during transportation or storage, which would make the transporter or the beverage industry need to get a certain space for storing the portable cup holders. It is impossible to avoid the waste of space, which make transporter or the beverage industry reduce the number of portable cup holders in transportation or storage.

In addition, the existing paper cup holders have poor load capacity, and there is a high risk of bottom breakage or damage when placing large-volume beverages.

SUMMARY OF THE INVENTION

A main object of the invention is to solve the problem of poor load capacity of the conventional paper cup holder.

In order to achieve the above object, the invention provides a paper cup holder with carrying handles comprising a first base board, a first wall board connected to one side of the first base board, a surface board connected to one side of the first wall board, a second wall board connected to one side of the surface board, and a second base board connected to one side of the second wall board. The surface board is formed with two symmetrically disposed carrying handle forming line sets and at least two cup inlet forming lines. Each of the two carrying handle forming line sets includes an outer secant line and an inner secant line facing the other one of the two carrying handle forming line sets. A starting point and an end point of each of the cup inlet forming lines are located on the inner secant line. The surface board forms two carrying handles based on the two carrying handle forming line sets and simultaneously forms two hollow areas on the surface board, and each of the two hollow areas and at least one of the cup inlet forming lines jointly form a cup inlet. The first base board, the first wall board, the surface board, the second wall board, and the second base board are located on a same extension line and connected in sequence. The surface board, the first wall board, the second wall board, the first base board and the second base board form a tubular structure. The surface board serves as a top surface of the tubular structure. The first base board and the second base board are overlapped with each other and jointly serve as a bottom surface of the tubular structure. The first base board is divided by a bending line into a bottom surface forming part partially overlapping the second base board and a supporting part capable of connecting with the surface board.

In one embodiment, the first base board includes a first auxiliary part forming line, the starting point and the end point of the first auxiliary part forming line are not connected with each other, the first base board forms a first auxiliary part based on the first auxiliary part forming line, the root of the first auxiliary part is located on the first base board, and the top of the first auxiliary part is connected to the surface board.

In one embodiment, the first auxiliary part forms two first fins at one end connected to the surface board, and the two first fins are glued to the root of one of the two carrying handles.

In one embodiment, the second base board and the second wall board are provided with a second auxiliary part forming line, the starting point and the end point of the second auxiliary part forming line are not connected with each other, and the starting point and the end point are both located on the second base board, the second auxiliary part forming line is formed with a second auxiliary part, the root of the second auxiliary part is located on the second base board, and the top of the second auxiliary part is connected to the surface board.

In one embodiment, the second auxiliary part forms two second fins at one end connected to the surface board, and the two second fins are glued to the root of one of the two carrying handles.

In one embodiment, the quantity of the cup inlet forming lines facing each of the two inner secant lines is equal.

In one embodiment, each of the outer secant lines comprises two straight line segments disposed at interval and a continuous curve segment connecting with the two straight line segments at two ends respectively.

In one embodiment, the tubular structure includes a central axis connecting with two tubular openings, and the long side of each of the carrying handles is perpendicular to the central axis.

Through the foregoing implementation of the invention, the invention includes the following features compared with the prior art: the first base board and the second base board of the invention are connected with each other in an overlapping manner, and the supporting part of the first base board is connected to the surface board to strengthen the load capacity of a bottom of the paper cup holder.

DETAILED DESCRIPTION OF THE PREFERRED EMBODIMENTS

The detailed description and technical contents of the invention are described below with reference to the drawings.

Figure 1:
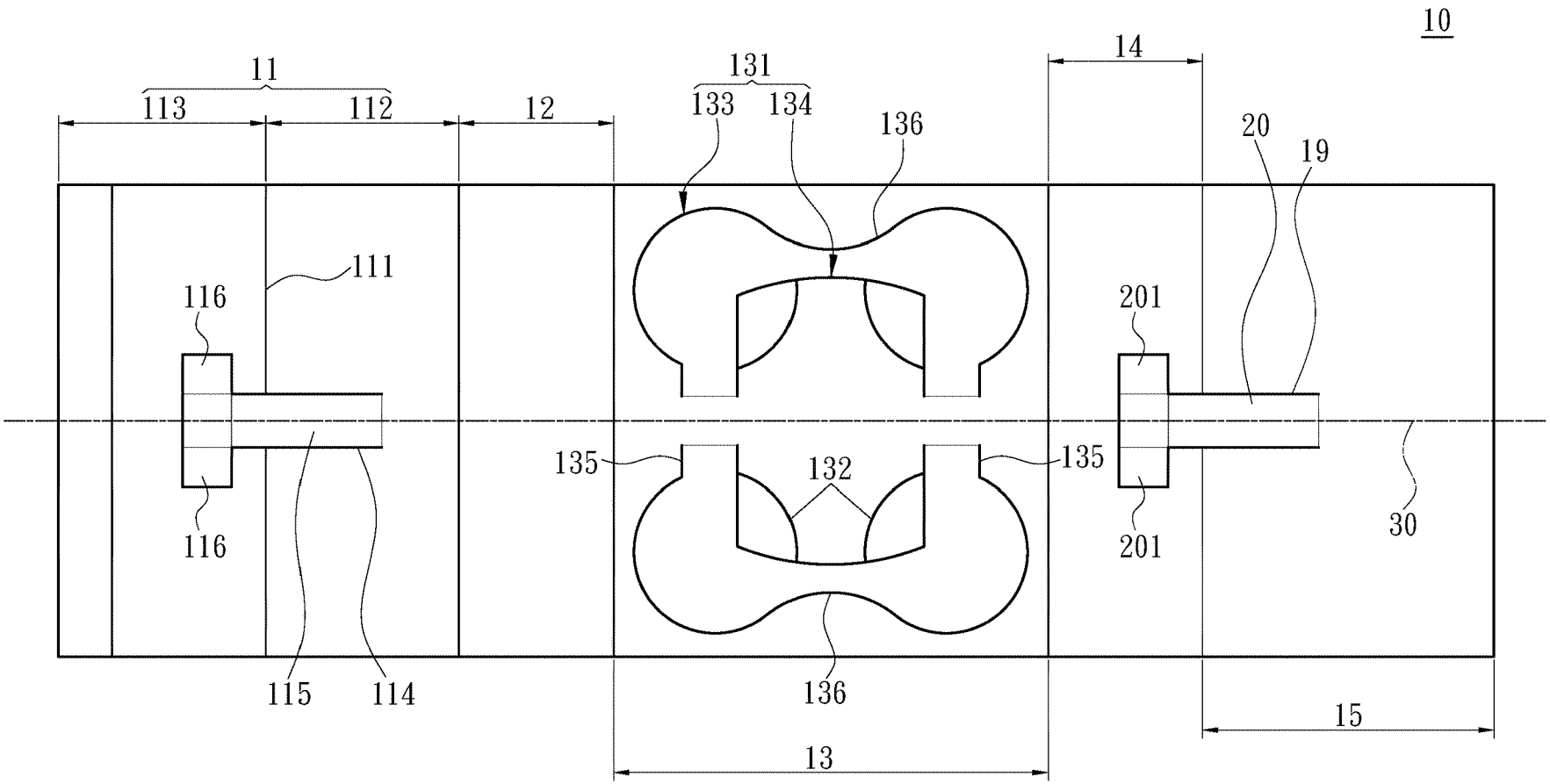
FIG. 1 is an unfolded schematic diagram of a paper cup holder of the invention without forming a tubular structure.
Figure 2:
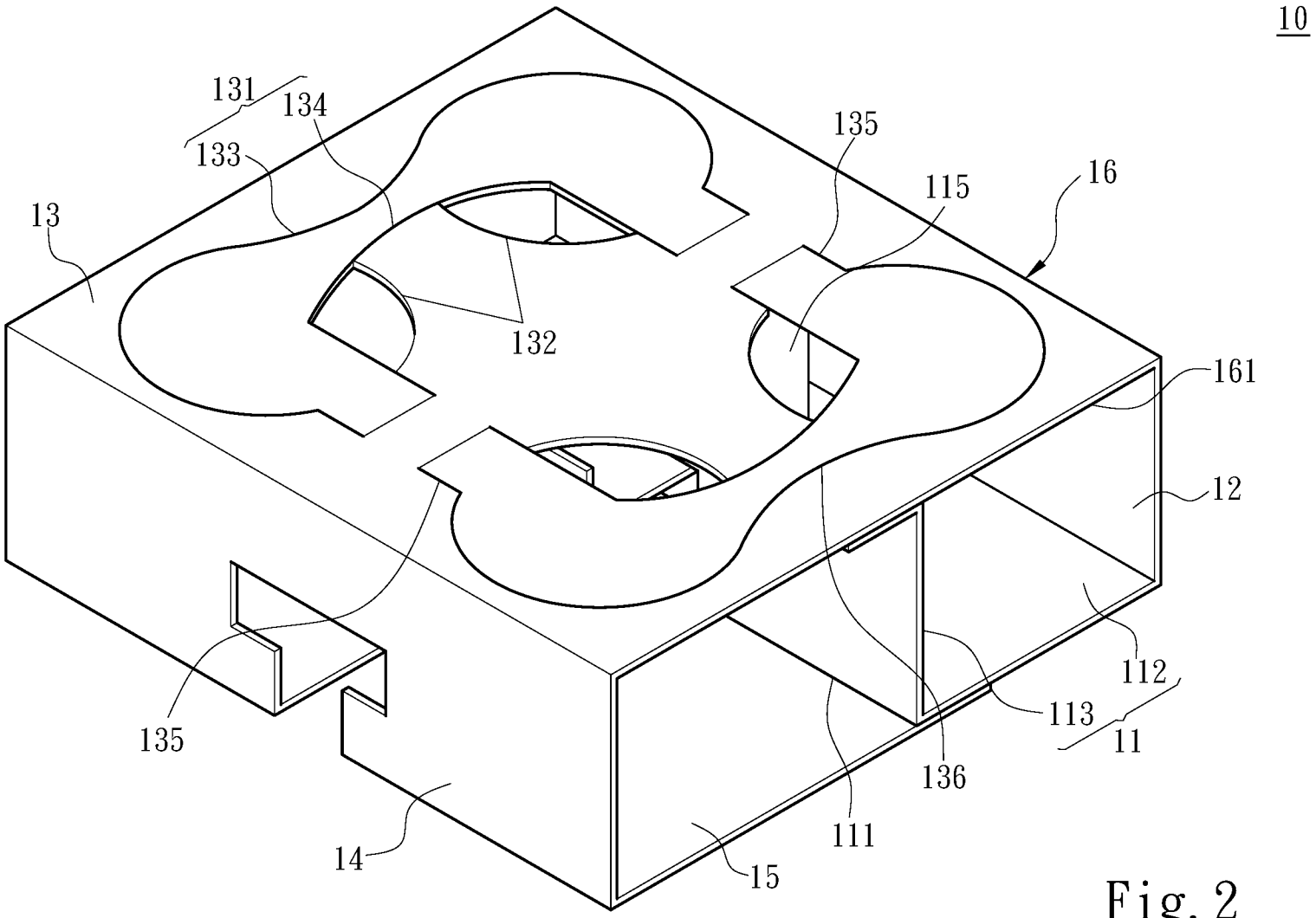
FIG. 2 is a structural perspective view of the paper cup holder of the invention without forming carrying handles.
Figure 3:
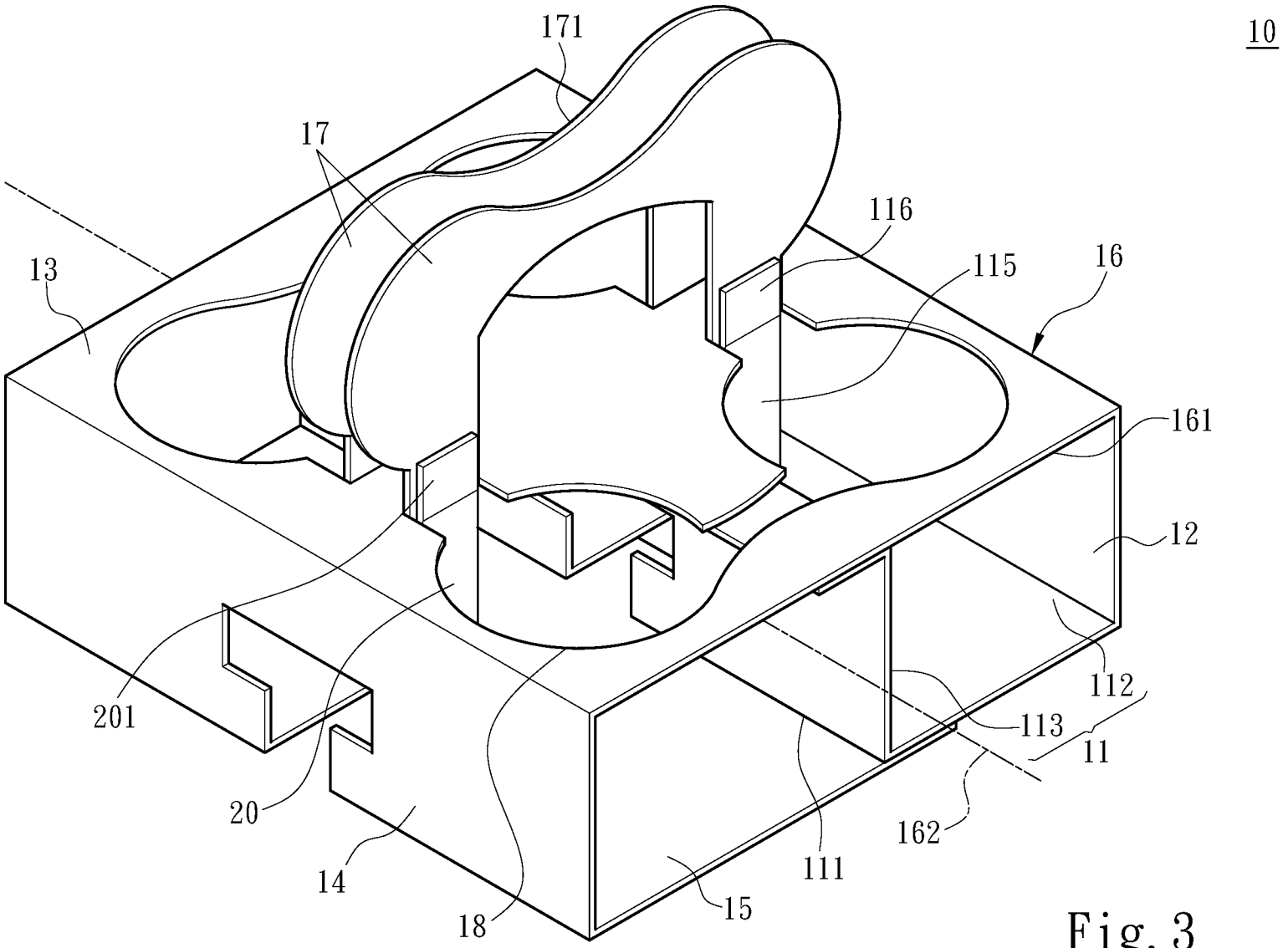
FIG. 3 is a structural perspective view of the paper cup holder of the invention.
Figure 4:
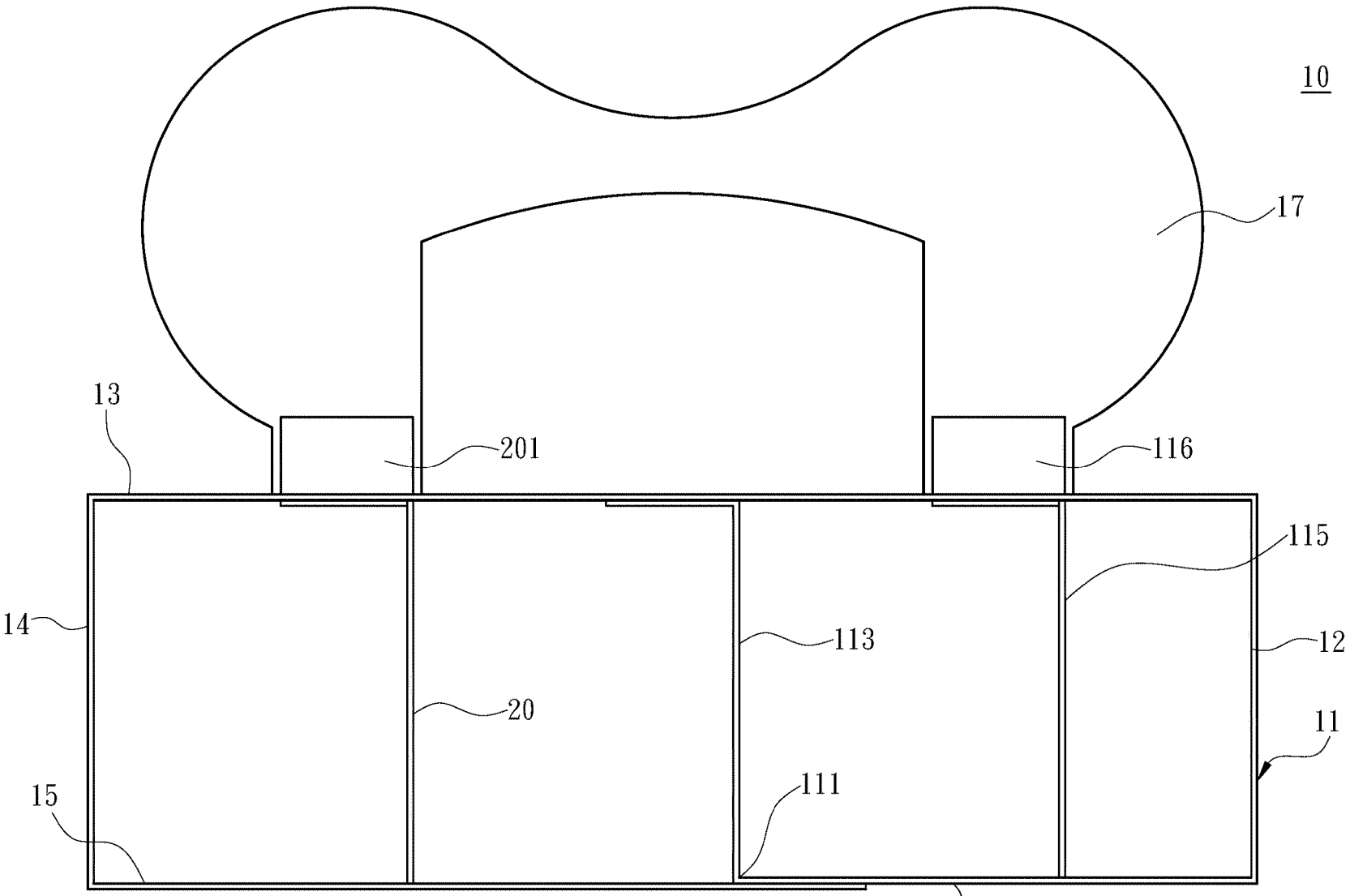
FIG. 4 is a side view of the paper cup holder of the invention viewed from a tubular opening.

Please refer to FIG. 1, FIG. 2, and FIG. 3. The invention provides a paper cup holder 10 with carrying handles. The entire paper cup holder 10 is made of paper except an adhesive part. The paper cup holder 10 is stacked and stored in a flat form when not in use. The paper cup holder 10 comprises a first base board 11, a first wall board 12 connected to one side of the first base board 11, a surface board 13 connected to one side of the first wall board 12, a second wall board 14 connected to one side of the surface board 13, and a second base board 15 connected to one side of the second wall board 14. When the paper cup holder 10 is unfolded, the first base board 11, the first wall board 12, the surface board 13, the second wall board 14 and the second base board 15 are located on an extension line 30 and connected in sequence. The first base board 11, the first wall board 12, the surface board 13, the second wall board 14 and the second base board 15 are bent in sequence to form a tubular structure 16, as shown in FIG. 2. The surface board 13 serves as the top surface of the tubular structure 16, and the bottom surface of the tubular structure 16 is formed by the first base board 11 and the second base board 15 that are overlapped with each other. Further, the first base board 11 is divided by a bending line 111 into a bottom surface forming part 112 and a supporting part 113 connected to the bottom surface forming part 112. When the tubular structure 16 is formed, the bottom surface forming part 112 is not only serving as a part of the bottom surface of the tubular structure 16, but also partially overlapping with the second base board 15, and the adhesive is applied to the overlapped part. The supporting part 113 is bent relative to the bottom surface forming part 112 based on the bending line 111 to connect with the surface board 13. The supporting part 113 is connected to the surface board 13 by bonding with the adhesive. Observing from one of two tubular openings 161 of the tubular structure 16, it can be directly found that the supporting part 113 is erected therein, as shown in FIG. 4. When the paper cup holder 10 of the invention is implemented, the main object of the supporting part 113 is not to support the forming of the tubular structure 16, but to strengthen the load capacity of the bottom of the tubular structure 16 through connection with the surface board 13 to prevent the bottom of the paper cup holder 10 from breaking when being provided for placing large-volume beverages.

Please refer to FIG. 1, FIG. 2, and FIG. 3. The surface board 13 is formed with two carrying handle forming line sets 131 which are symmetrically disposed and at least two cup inlet forming lines 132. Each of the two carrying handle forming line sets 131 includes an outer secant line 133, and an inner secant line 134 facing the other of the two carrying handle forming line sets 131. A starting point and an end point of each of the cup inlet forming lines 132 are located on the inner secant line 134. In one embodiment, each of the at least two cup inlet forming lines 132 is a secant line. In one embodiment, each of the cup inlet forming lines 132 is configured as an arc. In addition, in order to maintain the balance of the paper cup holder 10, in one embodiment, the quantity of the cup inlet forming lines 132 facing each of the two inner secant lines 134 are equal. Two carrying handles 17 based on the two carrying handle forming line sets 131 and two hollow areas are simultaneously formed on the surface board 13. Each of the two hollow areas forms a cup inlet 18 with at least one of the cup inlet forming lines 132 jointly. Furthermore, in one embodiment, the outer secant line 133 of each of the two carrying handle forming line sets 131 comprises two straight line segments 135 disposed at interval and a continuous curve segment 136 connecting with the two straight line segments 135 at two ends respectively, and the continuous curve segment 136 is designed to correspond to a gesture of a user holding the two carrying handles 17, so that it is convenient for the user to carry the paper cup holder 10 of the invention by hand. The surface board 13 of the invention does not need to form the two carrying handles 17 and a plurality of cup inlets 18 separately, so that the plurality of cup inlets 18 can utilize the surface board 13 to a greatest extent. Vendors can take volume requirements into consideration during transportation or display of the invention in order to reduce waste of space.

Please refer to FIG. 1, FIG. 2, and FIG. 3. In one embodiment, the first base board 11 includes a first auxiliary part forming line 114, and a starting point and an end point of the first auxiliary part forming line 114 are not connected with each other. The first base board 11 forms a first auxiliary part 115 based on the first auxiliary part forming line 114, and a root of the first auxiliary part 115 is located on the first base board 11, and a top of the first auxiliary part 115 is adhered to the surface board 13. In this way, in this embodiment, it can be observed from the one of the two tubular openings 161 of the tubular structure 16 that both the supporting part 113 and the first auxiliary part 115 are erected in the tubular structure 16 as shown in FIG. 4. The first auxiliary part 115 of the invention strengthens the load capacity of the bottom of the tubular structure 16 through connection with the surface board 13. The position of the surface board 13 connected to the first auxiliary part 115 is located at a part between roots of the two carrying handles 17, so as to strengthen the structural strength of the surface board 13 at the position and prevent the surface board 13 from breaking at the roots of the two carrying handles 17 when the paper cup holder 10 bears weights. In one embodiment, the first auxiliary part 115 forms two first fins 116 at one end connected to the surface board 13, and the two first fins 116 are bonded to the root of one of the two carrying handles 17 by the adhesive when the first auxiliary part 115 is connected to the surface board 13. When the two first fins 116 are implemented, they can increase not only the load reinforcement provided by the first auxiliary part 115 for the first base board 11, but also the structural strength of the root of one of the two carrying handles 17.

Figure 5:
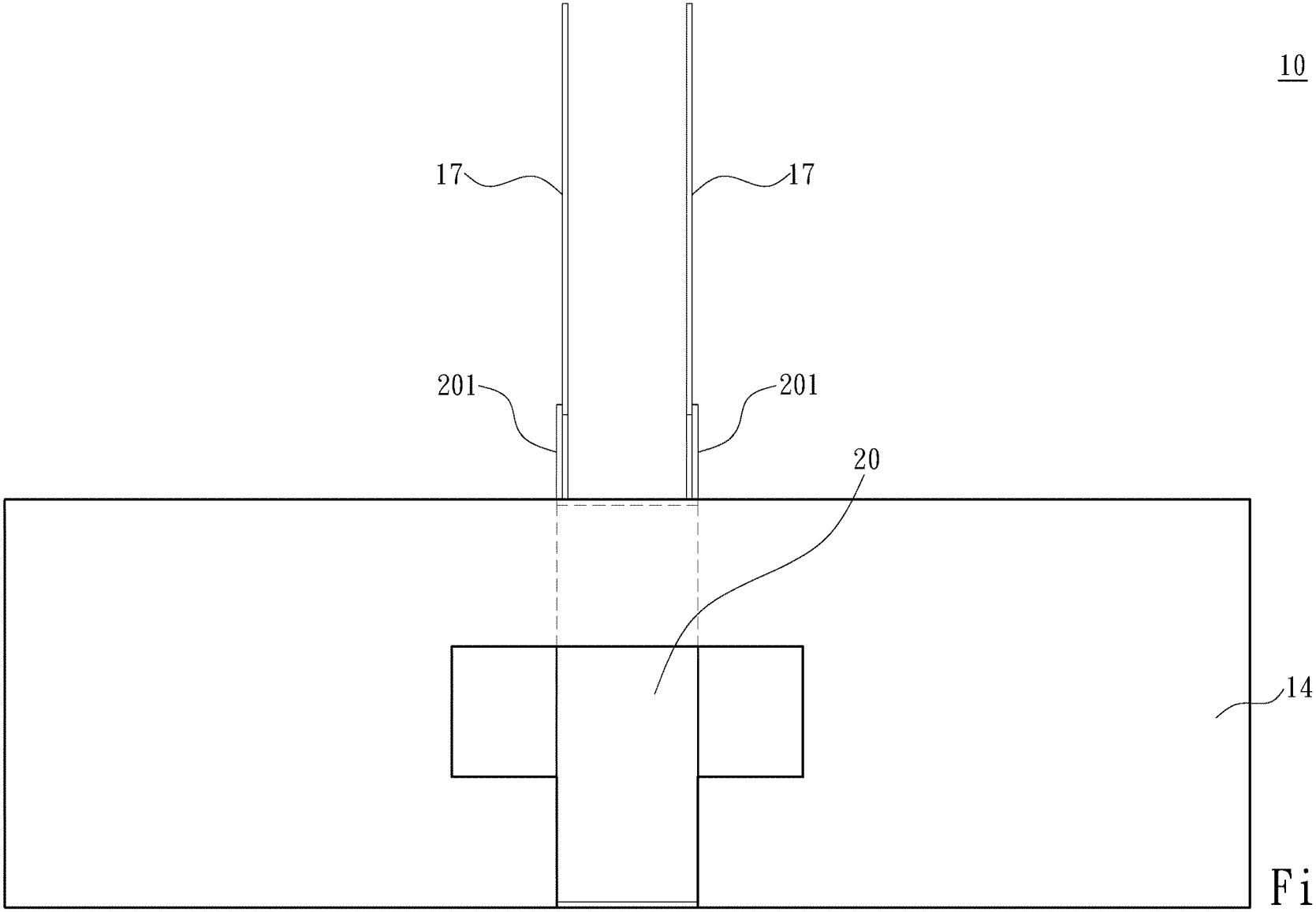
FIG. 5 is a side view of the paper cup holder of the invention viewed from a second wall board.

Please refer to FIG. 1, FIG. 2, and FIG. 3. In one embodiment, the second base board 15 and the second wall board 14 are provided with a second auxiliary part forming line 19. A starting point and an end point of the second auxiliary part forming line 19 are not connected with each other, and the starting point and the end point are both located on the second base board 15. The second auxiliary part forming line 19 is formed with a second auxiliary part 20. A root of the second auxiliary part 20 is located on the second base board 15, and a top of the second auxiliary part 20 is connected to the surface board 13 by bonding with the adhesive. In this way, in this embodiment, it can be observed from the one of the two tubular openings 161 of the tubular structure 16 that both the supporting part 113 and the second auxiliary part 20 are erected in the tubular structure 16 as shown in FIG. 4. The second auxiliary part 20 of the invention strengthens the load capacity of the bottom of the tubular structure 16 through connection with the surface board 13. The position of the surface board 13 being connected to the second auxiliary part 20 can be located at a part between the roots of the two carrying handles 17, as shown in FIG. 5, so as to strengthen the structural strength of the surface board 13 at the position and prevent the surface board 13 from breaking at the roots of the two carrying handles 17 when the paper cup holder 10 bears weights. In one embodiment, the second auxiliary part 20 forms two second fins 201 at one end connected to the surface board 13, and the two second fins 201 are bonded to the root of one of the two carrying handles 17 by the adhesive when the second auxiliary part 20 is connected to the surface board 13. When the two second fins 201 are implemented, they can increase not only the load reinforcement provided by the second auxiliary part 20 for the second base board 15, but also the structural strength of the root of one of the two carrying handles 17.

Please refer to FIG. 1, FIG. 2, and FIG. 3. In one embodiment, the tubular structure 16 includes a central axis 162 connecting with the two tubular openings 161, and a long side 171 of each of the carrying handles 17 perpendicular to the central axis 162. In this embodiment, the disposing direction of the two carrying handles 17 can prevent the surface board 13 from being seriously deformed when the paper cup holder 10 bears weights.

What is claimed is:

1. A paper cup holder with carrying handles, comprising:

a first base board;

a first wall board, connected to one side of the first base board;

a surface board, connected to one side of the first wall board, the surface board being formed with two carrying handle forming line sets which are symmetrically disposed, and at least two cup inlet forming lines, each of the two carrying handle forming line sets including an outer secant line and an inner secant line facing the other one of the two carrying handle forming line sets, and a starting point and an end point of each of the at least two cup inlet forming lines located on the inner secant line, wherein the surface board forms two carrying handles based on the two carrying handle forming line sets and simultaneously forms two hollow areas on the surface board, and each of the two hollow areas and at least one of the at least two cup inlet forming lines jointly forming a cup inlet;

a second wall board, connected to one side of the surface board; and a second base board, connected to one side of the second wall board;

wherein the first base board, the first wall board, the surface board, the second wall board and the second base board are located on one extension line and connected in sequence;

wherein the surface board, the first wall board, the second wall board, the first base board and the second base board form a tubular structure, the surface board serves as a top surface of the tubular structure, the first base board and the second base board are overlapped with each other and jointly serve as a bottom surface of the tubular structure, the first base board is divided by a bending line into a bottom surface forming part partially overlapping the second base board and a supporting part connecting with the surface board.

2. The paper cup holder with the carrying handles as claimed in claim 1, wherein the first base board includes a first auxiliary part forming line, a starting point and an end point of the first auxiliary part forming line are not connected with each other, the first base board forms a first auxiliary part based on the first auxiliary part forming line, a root of the first auxiliary part is located on the first base board, and a top of the first auxiliary part is connected to the surface board.

3. The paper cup holder with the carrying handles as claimed in claim 2, wherein the first auxiliary part forms two first fins at one end connected to the surface board, and the two first fins are respectively adhered to a root of one of the two carrying handles and a root of another one of the two carrying handles.

4. The paper cup holder with the carrying handles as claimed in claim 2, wherein the second base board and the second wall board are provided with a second auxiliary part forming line, a starting point and an end point of the second auxiliary part forming line are not connected with each other, and the starting point and the end point are both located on the second base board, the second auxiliary part forming line is formed with a second auxiliary part, a root of the second auxiliary part is located on the second base board, and a top of the second auxiliary part is connected to the surface board.

5. The paper cup holder with the carrying handles as claimed in claim 4, wherein the second auxiliary part forms two second fins at one end connected to the surface board, and the two second fins are respectively glued to a root of one of the two carrying handles and a root of another one of the two carrying handles.

6. The paper cup holder with the carrying handles as claimed in claim 5, wherein a quantity of the cup inlet forming lines facing each of the two inner secant lines is equal.

7. The paper cup holder with the carrying handles as claimed in claim 6, wherein the tubular structure includes a central axis connecting with two tubular openings, and a long side of each of the carrying handles is perpendicular to the central axis.

8. The paper cup holder with the carrying handles as claimed in claim 1, wherein a quantity of the cup inlet forming lines facing each of the two inner secant lines is equal.

9. The paper cup holder with the carrying handles as claimed in claim 8, wherein each of the outer secant lines comprises two straight line segments disposed separately and a continuous curve segment connecting with the two straight line segments at two ends respectively.

10. The paper cup holder with the carrying handles as claimed in claim 9, wherein the tubular structure includes a central axis connecting with two tubular openings, and a long side of each of the carrying handles is perpendicular to the central axis.

11. The paper cup holder with the carrying handles as claimed in claim 1, wherein the tubular structure includes a central axis connecting with two tubular openings, and a long side of each of the carrying handles is perpendicular to the central axis.

* * * * *